US007703818B2

(12) United States Patent
Fannon et al.

(10) Patent No.: US 7,703,818 B2
(45) Date of Patent: Apr. 27, 2010

(54) VEHICLE DOOR LATCH STRIKER

(75) Inventors: Joseph P. Fannon, Washington, MI (US); Richard K. Mette, Shelby Township, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 155 days.

(21) Appl. No.: 11/551,277

(22) Filed: Oct. 20, 2006

(65) Prior Publication Data

US 2008/0100070 A1 May 1, 2008

(51) Int. Cl.
*E05B 15/02* (2006.01)
*E05B 15/00* (2006.01)

(52) U.S. Cl. ..... 292/340; 292/341.14

(58) Field of Classification Search ..... 5/340, 5/341, 341.14, DIG. 56; 292/340, 341, 341.14, 292/DIG. 56; 411/399
See application file for complete search history.

(56) References Cited

U.S. PATENT DOCUMENTS 2,141,771 A * 12/1938 Sparling ..... 474/223
2,527,616 A * 10/1950 Beckstrom ..... 403/408.1
3,680,902 A * 8/1972 Slattery ..... 292/341.14
4,602,813 A * 7/1986 Gergoe et al. ..... 292/340
4,883,298 A * 11/1989 Kleefeldt ..... 292/341.12
4,981,313 A * 1/1991 Makamura ..... 292/340
4,987,313 A * 1/1991 Baatz et al. ..... 250/506.1
4,998,759 A * 3/1991 Peterson et al. ..... 292/340
5,028,084 A * 7/1991 Fukumoto et al. ..... 292/337
5,215,342 A * 6/1993 Yuge et al. ..... 292/340
5,263,752 A 11/1993 Phail-Fausey et al.
5,316,354 A 5/1994 Arabia, Jr. et al.
5,494,208 A * 2/1996 Granger ..... 228/173.6
5,529,356 A * 6/1996 Cetnar ..... 292/340
5,671,521 A * 9/1997 Briles ..... 29/407.05
5,680,690 A * 10/1997 Briles et al. ..... 29/458
5,707,092 A 1/1998 Van Slembrouck et al.
5,785,365 A 7/1998 Lorey
6,073,980 A 6/2000 Arabia, Jr. et al.
6,095,576 A 8/2000 Burton
6,106,037 A * 8/2000 Burton ..... 292/340
6,273,480 B1 8/2001 Burton
6,672,634 B2 1/2004 Burton
6,698,080 B2 * 3/2004 Sawajiri et al. ..... 29/509

(Continued)

FOREIGN PATENT DOCUMENTS

EP 0894918 A1 2/1999

(Continued)

OTHER PUBLICATIONS

American Society for Metals, American Society for Steel Treating, Metal progress, vol. 93, 1968, pp. 12 and 70.*

*Primary Examiner*—Peter M Cuomo
*Assistant Examiner*—Alyson M Merlino

(57) ABSTRACT

A striker assembly for use with a vehicle door latch is disclosed. The striker assembly may include a U-shaped strap that mounts to vehicle body structure, and a striker pin that is mounted to the strap. The striker pin may include a neck that is peened to form a head and neck that fills a countersunk pocket in a pin support arm of the strap. The strap may also have a base plate that mounts to vehicle structure and includes one or more water drain channels and a coined edge to better control water drainage and intrusion.

14 Claims, 3 Drawing Sheets

U.S. PATENT DOCUMENTS

2004/0119299 A1* 6/2004 Paskonis ..... 292/340
2005/0140148 A1* 6/2005 Stoof et al. ..... 292/216
2005/0167993 A1* 8/2005 Paskonis ..... 292/296
2005/0218669 A1* 10/2005 Johnson et al. ..... 292/340
2007/0040392 A1* 2/2007 Matsuki ..... 292/262

FOREIGN PATENT DOCUMENTS

EP 1275802 A1 1/2003

* cited by examiner

VEHICLE DOOR LATCH STRIKER

BACKGROUND OF THE INVENTION

The present application relates generally to vehicle door latch and striker assemblies, and more particularly to a striker assembly that is attached to vehicle structure and engaged by a door latch when a vehicle door is closed.

Automotive vehicles are typically equipped with a door latch mounted in each door that engages a striker assembly mounted to vehicle structure, such as a vehicle door jam. The latch typically has a fish mouth slot that engages with a striker pin to hold the door in its closed position.

For some striker assemblies, a striker pin is attached to a U-shaped strap having a base that is bolted to the vehicle structure. The striker pin may have a shank that slides through the base, with a larger portion that bottoms in the base to retain the pin in the base, and an opposed end that is secured in a concentric hole through the other end of the strap. For various cost, performance, and aesthetic reasons, many of these prior striker assemblies are not as desirable as they could be.

The striker assemblies used in today's vehicles must not only satisfy strength and durability requirements, but must do so while still enabling the door system to perform satisfactorily under various environmental conditions, all while improving the visual aesthetics of the striker assemblies and providing a perceived quality feel for customers when opening and closing the vehicle doors.

SUMMARY OF THE INVENTION

An embodiment contemplates a striker assembly for use with a vehicle door latch. The striker assembly may comprise a generally U-shaped strap and a striker pin. The generally U-shaped strap has a base plate adapted to mount to vehicle structure, a pin support arm spaced from and extending generally parallel to the base plate, and an intermediate arm extending between the base plate and the pin support arm. The pin support arm has an inner surface facing the base plate and an opposed outer surface. The base plate includes a first pin hole and the pin support arm includes a second pin hole coaxial with the first pin hole, with the second pin hole including a countersunk pocket adjacent to the outer surface. The striker pin has a generally cylindrical shank portion located between a base head and a pin neck, with the base head engaged by the base plate, and the pin neck having a peened portion filling the countersunk pocket and a peen head engaging the outer surface adjacent to the second pin hole.

An embodiment contemplates a striker assembly for use with a vehicle door latch. The striker assembly may comprise a generally U-shaped strap having a base plate adapted to mount to vehicle structure, a pin support arm spaced from and extending generally parallel to the base plate, and an intermediate arm extending between the base plate and the pin support arm. The base plate includes a first pin hole and the pin support arm includes a second pin hole coaxial with the first pin hole. The base plate has a front surface facing the pin support arm, an opposed back surface adapted to be secured against the vehicle structure and an edge extending between the front surface and the back surface, with the back surface including a water drain channel recessed therein and extending from adjacent to the edge toward a central portion of the back surface. The striker assembly may also comprise a striker pin secured to the strap and having a generally cylindrical shank portion extending between the first pin hole and the second pin hole.

An embodiment contemplates a striker assembly for use with a vehicle door latch. The striker assembly may include a generally U-shaped strap having a base plate adapted to mount to vehicle structure, a pin support arm spaced from and extending generally parallel to the base plate, and an intermediate arm extending between the base plate and the pin support arm, the base plate including a first pin hole and the pin support arm including a second pin hole coaxial with the first pin hole; and a striker pin secured to the strap and having a generally cylindrical shank portion extending between the first pin hole and the second pin hole, the striker pin being made of a 10B21 boron steel alloy.

An advantage of an embodiment is that the striker assembly is relatively low cost and has an aesthetically pleasing appearance, while meeting its functional requirements, such as strength, durability, and corrosion resistance.

An advantage of an embodiment is that water, which may otherwise become trapped between a base plate of the striker assembly and the vehicle structure, can be drained through a water drain channel. Also, a coined edge on the base plate may provide a better seal plane for base plate mounting flanges secured against the vehicle structure in order to reduce the risk of water intrusion into the vehicle structure through its mounting holes.

DETAILED DESCRIPTION

Figure 1:
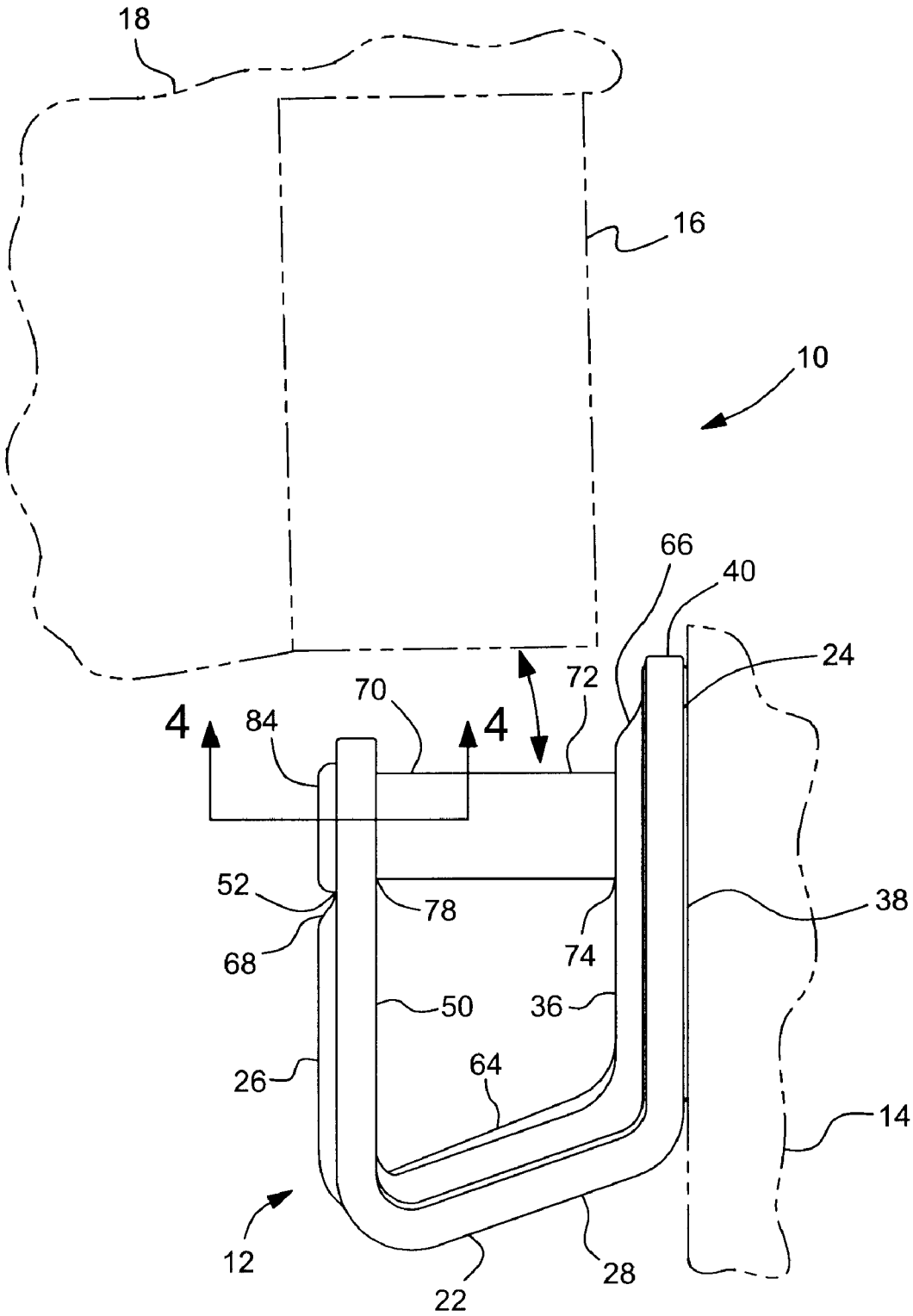
FIG. 1 is a partially schematic, plan view of a striker and latch assembly for a vehicle door, but with a plastic cover not shown.
Figure 2:
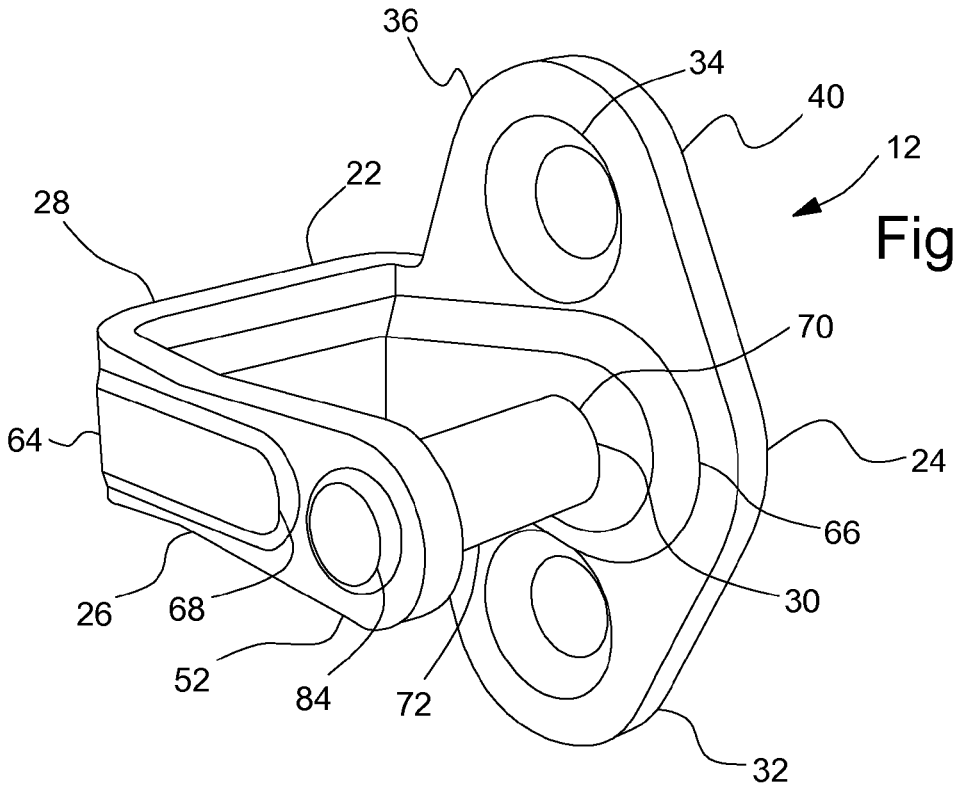
FIG. 2 is a perspective view of a striker assembly of FIG. 1.
Figure 3:
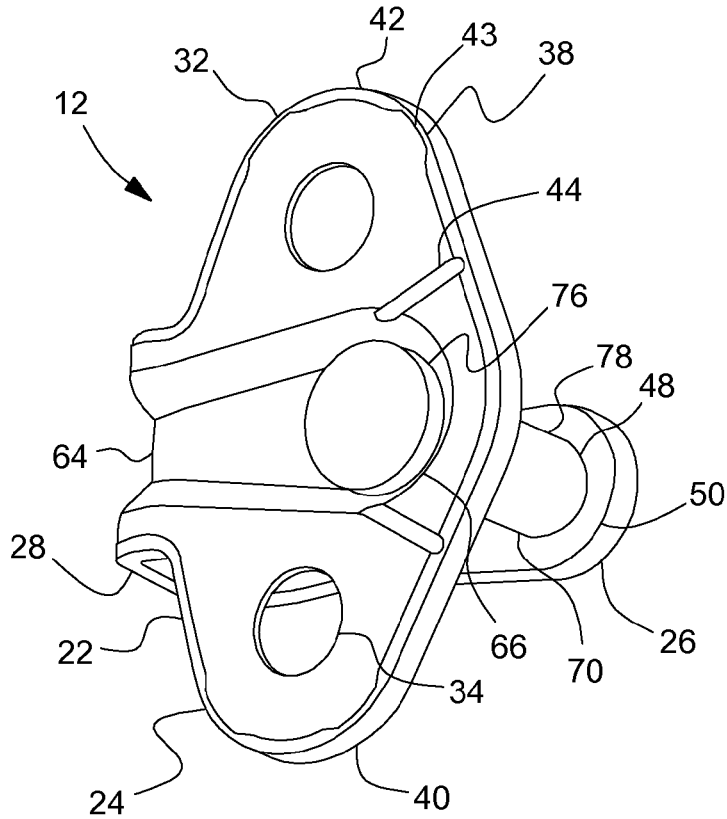
FIG. 3 is a perspective view of the striker assembly of FIG. 2, but taken from a different angle.

FIGS. 1-5 illustrate a striker and latch assembly 10 having a striker assembly 12 mounted to vehicle body structure 14, such as a doorjamb pillar, and a latch assembly 16 mounted to a free end of a pivoting vehicle door 18 (shown schematically in FIG. 1). The latch assembly 16 may be conventional, if so desired, and so will not be shown or discussed in more detail herein. A portion of the striker assembly 12 may be covered by a plastic cover 20 (shown in FIG. 5) in order to improve the overall aesthetic appearance of the striker assembly 12, but is not required.

The striker assembly 12 includes a generally U-shaped strap 22 having a base plate 24, a pin support arm 26 that extends generally parallel to the base plate 24, and an intermediate arm 28, extending between and supporting the pin support arm 26 relative to the base plate 24. The base plate 24, pin support arm 26 and intermediate arm 28 are preferably integral—that is, formed from a single piece of material. This material may be, for example, a high strength, low alloy steel, an advantage of which is that it can provide acceptable strength without the need for heat treatment. Of course, other suitable materials may be employed and the strap 22 may be made up of multiple pieces secured together, if so desired.

The base plate 24 includes a first pin hole 30, with a pair of mounting flanges 32 extending outwardly therefrom. Each mounting flange 32 includes a mounting hole 34 for receiving a fastener, such as a bolt (not shown), to secure the base plate 24 to the body structure 14. The base plate 24 also has a front surface 36, which faces the pin support arm 26, an opposed back surface 38, which faces the body structure 14, and an edge 40 extending between the front and back surfaces 36, 38 around most of the perimeter of the base plate 24. A coined edge 42—between the back surface 38 and edge 40—extends around most of the perimeter of the base plate 24. The coined edge 42 may include four contoured portions 43 where the width of the coining is substantially reduced (or almost eliminated). The contoured portions 43 are located along the perimeter where the coined edge 42 comes closest to the centers of the mounting holes 34. The coined edge 42 with the contoured portions 43 may help to provide a better seal plane between the back surface 38 and the surface of the body structure 14, minimizing the risk of water intrusion through mounting holes (not shown) in the body structure 14 while allowing for increased adjustability of the base plate 24 relative to the body structure 14. The base plate 24 may also include one or two water drain channels 44, recessed in the back surface 38, and extending from near the first pin hole 30 to the edge 40. The water drain channels 44 facilitate water drainage from between the back surface 38 and the vehicle body structure 14. Having two water drain channels 44 allows the striker assembly 12 to be used on either the left side or right side of the vehicle, while still providing the water drainage function.

Figure 4:
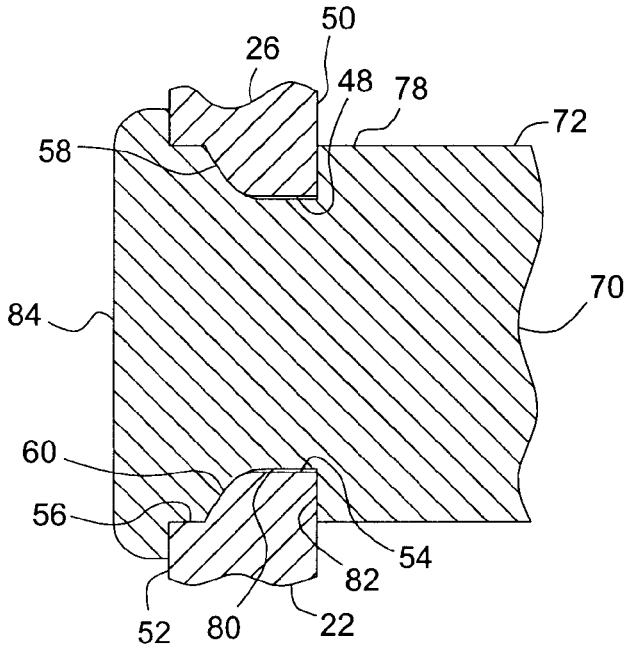
FIG. 4 is a section view taken along line 4-4 in FIG. 1.
Figure 5:
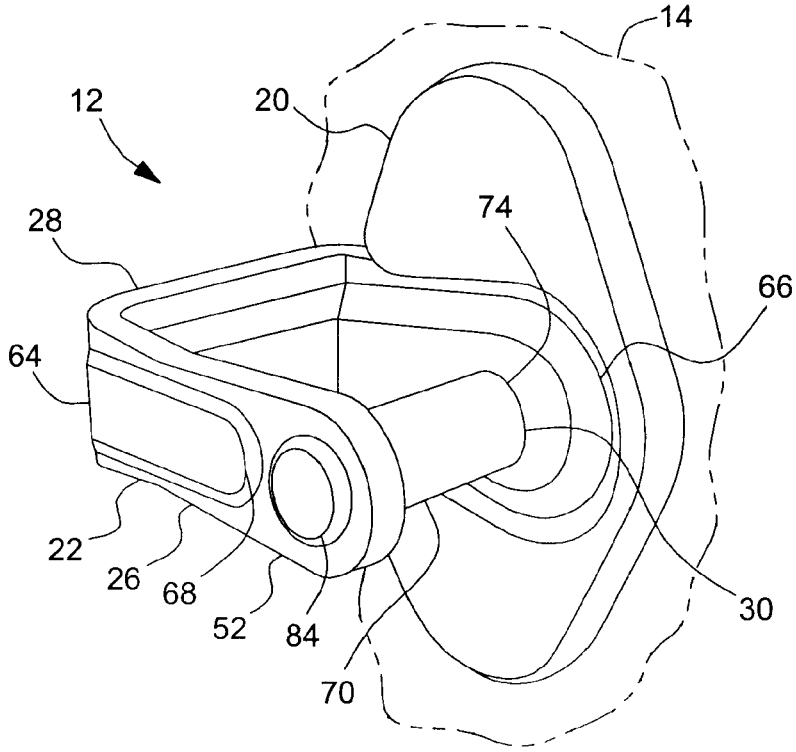
FIG. 5 is a perspective view of a striker assembly, similar to FIG. 2, but illustrating the striker assembly after installation in a vehicle.

The pin support arm 26 includes a second pin hole 48, extending between an inner surface 50 that faces the base plate 24 and an opposed outer surface 52. The second pin hole 48 is concentric with the first pin hole 30. The second pin hole 48 includes an entrance portion 54 adjacent to the inner surface 50 and an exit portion 56 adjacent to the outer surface 52, with the entrance portion 54 having a smaller diameter than the exit portion 56 (best seen in FIG. 4). A tapered portion 58 extends between the exit portion 56 and the entrance portion 54. The tapered portion 58 may be curved, as is shown in FIG. 4, or, alternatively, may extend in a straight line taper like a chamfer, if so desired. The exit portion 56 and tapered portion 58 define a counter sunk pocket 60.

The strap 22 may have a stiffening bead 64 that extends from a first end 66, surrounding the first pin hole 30, along the intermediate arm 28 and terminating at a second end 68, adjacent to the second pin hole 48. The first end 66 of the stiffening bead 64, then, would form a recessed area in the back surface 38 of the base plate 24, around the first pin hole 30. The water drain channels 44 may extend from this recessed area out to the coined edge 42 or edge 40.

The striker assembly 12 also includes a striker pin 70. The striker pin 70 is preferably formed of a high strength material, such as, for example, a 10B21 boron steel alloy. The term 10B21 boron steel (and reference to 10B21 boron steel alloy) as used in the specification and claims herein, has a composition as defined by the Society of Automotive Engineers (SAE) standards for steel that were in place on Oct. 20, 2006. The material may be pre-heat treated to a Rockwell C hardness of about 35 or less, such that its yield strength is maximized while keeping below a hardness level that may risk hydrogen embrittlement during an electroplating surface finish operation. Alternatively, the striker pin 70 may be formed from a different high strength material, such as, for example, stainless steel.

The striker pin 70 has a cylindrical shank 72, with a base end 74 adjacent to a base head 76 and an opposed support end 78 adjacent to a pin neck 80. The base head 76 has a diameter larger than the first pin hole 30, while the shank 72 has, and the pin neck 80 initially has, a diameter smaller than the first pin hole 30. The pin neck 80 has a smaller diameter than the shank 72 at the support end 78, forming a shoulder 82 that abuts the inner surface 50 of the pin support arm 26. The pin neck 80 is peened in the second pin hole 48 so that it fills the countersunk pocket 60 and forms a peen head 84 overlapping the outer surface 52 around the second pin hole 48. Preferably, the peen head 84 has a diameter that is larger than the diameter of the shank 72. The striker pin 70, filling the countersunk pocket 60 and forming the peen head 84, is provided with a sheer plain sufficient to resist sheer forces that may be induced by the latch 16 under a rotational loading condition. That is, a force extending generally longitudinally along the pin, induced by the latch 16, can be withstood by the striker pin 70 to ensure that the striker pin 70 remains secured in the second pin hole 48 of the pin support arm 26.

The assembly of the striker assembly 12 will now be described. The U-shaped strap 22 and striker pin 70 are formed—including creating the water drain channels 44, the coined edge 42, the stiffening bead 64, the first pin hole 30, and the countersunk pocket 60 in the strap 22. The striker pin 70 is inserted, pin neck end first, through the first pin hole 30. The striker pin 70 continues to be slid into the strap 22 until the pin neck 80 slips into the second pin hole 48 and the base head 76 bottoms out against the back surface 38 of the base plate 24. Preferably, the stiffening bead 64 is large enough so the base head 76 is completely recessed within the first end 66 of the stiffening bead 64. A peening operation is performed on the pin neck 80 to fill the countersunk pocket 60 while forming the peen head 84. The striker assembly 12 also may be coated with zinc or chrome (via electroplating or other means), or other suitable corrosion resistant material, in order to provide protection from the harsh environment in which the vehicle will operate. After mounting the striker assembly 12 to the vehicle body structure 14, the plastic cover 20 may be mounted over a portion of the base plate 24 in order to improve the aesthetic appearance of the assembly 12.

While certain embodiments of the present invention have been described in detail, those familiar with the art to which this invention relates will recognize various alternative designs and embodiments for practicing the invention as defined by the following claims.

What is claimed is:

1. A striker assembly for use with a vehicle door latch comprising:

a generally U-shaped strap having a base plate adapted to mount to a vehicle structure, a pin support arm spaced from and extending generally parallel to the base plate, and an intermediate arm extending between the base plate and the pin support arm; the base plate including a first pin hole and a stiffening bead having a first end surrounding the first pin hole, the base plate also having a front surface facing the pin support arm, an opposed back surface adapted to be secured against the vehicle structure, an edge extending between the front surface and the back surface, a coined edge extending partially around a perimeter of the base plate between the back surface and the edge wherein the coined edge includes at least one contoured portion where a width of the coined edge is reduced, and a water drain channel recessed in the back surface and extending from the coined edge to first end of the stiffening bead; the pin support arm having an inner surface facing the base plate and an opposed outer surface, and the pin support arm including a second pin hole coaxial with the first pin hole, with the second pin hole including a countersunk pocket adjacent to the outer surface; and the countersunk pocket including an entrance portion adjacent to the inner surface having a first diameter, an exit portion adjacent to the outer surface having a second diameter that is larger than the first diameter, and a radiused tapered portion extending between the entrance portion and the exit portion, with the radiused portion having a convex curvature facing into the pocket; and a striker pin made of a 10B21 boron steel alloy having a Rockwell C hardness less than 35, the striker pin having a generally cylindrical shank portion located between a base head and a pin neck, the base head engaged by the base plate, and the pin neck having a peened portion filling the countersunk pocket and a peen head extending out of the countersunk pocket and engaging the outer surface adjacent to and radially outward from the second pin hole.

2. The striker assembly of claim 1 including a plastic cover secured over the base plate.

3. The striker assembly of claim 1 wherein the stiffening bead extends from the first end surrounding the first pin hole to a second end adjacent to the second pin hole.

4. The striker assembly of claim 1 wherein the shank portion has a diameter that is larger than a diameter of the second pin hole, and the pin neck, adjacent to the shank portion, has a diameter that is smaller than the diameter of the shank portion, the pin neck and shank portion defining a shoulder therebetween, with the shoulder abutting the inner surface of the pin support arm adjacent to the second pin hole.

5. The striker assembly of claim 1 including a zinc coating covering the strap and at least the peened head portion of the striker pin.

6. A striker assembly for use with a vehicle door latch comprising:

a generally U-shaped strap having a base plate adapted to mount to a vehicle structure, a pin support arm spaced from and extending generally parallel to the base plate, and an intermediate arm extending between the base plate and the pin support arm, the base plate including a first pin hole and the pin support arm including a second pin hole coaxial with the first pin hole, and the base plate has a front surface facing the pin support arm, an opposed back surface adapted to be secured against the vehicle structure, an edge extending between the front surface and the back surface, and a coined edge extending around a majority of a perimeter of the base plate between the back surface and the edge, and the coined edge includes at least one contoured portion where a width of the coined edge is reduced, the back surface also including a water drain channel recessed therein and extending from the coined edge toward a central portion of the back surface; and a stiffening bead extending from a first end surrounding the first pin hole to a second end adjacent to the second pin hole, with the first end of the stiffening bead operatively meeting the water drain channel for draining water that may accumulate between the back surface and the vehicle structure; and a striker pin secured to the strap and having a generally cylindrical shank portion extending between the first pin hole and the second pin hole.

7. The striker assembly of claim 6 wherein the base plate includes a second water drain channel recessed in the back surface, spaced from the water drain channel, and extending from the coined edge toward the stiffening bead.

8. The striker assembly of claim 6 wherein the striker pin is made of a 10B21 boron steel alloy.

9. The striker assembly of claim 6 including a plastic cover secured over the base plate.

10. The striker assembly of claim 6 wherein the pin support arm has an inner surface facing the base plate and an opposed outer surface, and the second pin hole includes a countersunk pocket having an entrance portion adjacent to the inner surface having a first diameter, an exit portion adjacent to the outer surface having a second diameter that is larger than the first diameter, and a radiused tapered portion extending between the entrance portion and the exit portion, with the radiused portion having a convex curvature facing into the pocket.

11. The striker assembly of claim 10 wherein the striker pin is made of a 10B21 boron steel alloy having a Rockwell C hardness less than 35.

12. The striker assembly of claim 11 wherein the striker pin has a pin neck extending from the shank portion, the pin neck having a peened portion filling the countersunk pocket and a peen head extending out of the countersunk pocket and engaging the outer surface adjacent to the second pin hole.

13. The striker assembly of claim 12 including a zinc coating covering the strap and at least the peened head portion of the striker pin.

14. The striker assembly of claim 12 wherein the water drain channel extends from the central portion in a direction that is different from a direction that the stiffening bead extends from the first pin hole; and the base plate includes a second water drain channel recessed in the back surface, spaced from the water drain channel, and oriented to extend in a different direction from both the water drain channel and the stiffening bead, the second water drain channel extending from the coined edge to the stiffening bead.

* * * * *